US006153575A

United States Patent [19]

Gorton et al.

[11] Patent Number: 6,153,575

[45] Date of Patent: Nov. 28, 2000

[54] STORAGE STABILIZED 1,2-DICHLOROETHYLENE COMPOSITIONS

[75] Inventors: Earl M. Gorton, Sulphur; Ronald D. Olinger, Lake Charles, both of La.

[73] Assignee: PPG Industries Ohio, Inc., Cleveland, Ohio

[21] Appl. No.: 09/519,291

[22] Filed: Mar. 6, 2000

Related U.S. Application Data

[63] Continuation-in-part of application No. 09/267,190, Mar. 12, 1999.

[51] Int. Cl.[7] ..... C11D 3/26; C23G 5/02

[52] U.S. Cl. ..... 510/245; 510/176; 510/177; 510/365; 510/379; 510/411; 510/412; 510/415; 510/475; 134/2; 134/40; 134/41; 570/111; 570/113

[58] Field of Search ..... 510/176, 177, 510/245, 365, 379, 411, 412, 415, 475; 134/2, 40, 41; 570/111, 113

[56] References Cited

U.S. PATENT DOCUMENTS

| | | | |
|---|---|---|---|
| 3,043,888 | 7/1962 | Pray et al. | 260/652.5 |
| 3,796,755 | 3/1974 | Beckers et al. | 260/566 B |
| 4,026,956 | 5/1977 | Manner | 260/652.5 |
| 4,418,231 | 11/1983 | Pamer | 570/115 |

FOREIGN PATENT DOCUMENTS 1083698 9/1967 United Kingdom .

*Primary Examiner*—Necholus Ogden
*Assistant Examiner*—Brian P. Mruk
*Attorney, Agent, or Firm*—Irwin M. Stein

[57] ABSTRACT

Describes a stabilized trans-1,2-dichloroethylene composition having a low concentration of aliphatic aldehyde hydrazone, optionally in combination with an epoxide. The aliphatic aldehyde hydrazone was found to be more efficient than commercially used hydroquinone monomethylether (HQMME) in preventing the isomeric transformation of trans-1,2-dichloroethylene to cis-1,2-dichloroethylene during storage. Also described is a process for cleaning the surface of an article with the stabilized 1,2-dichloroethylene composition.

18 Claims, No Drawings

STORAGE STABILIZED 1,2-DICHLOROETHYLENE COMPOSITIONS

CROSS REFERENCE TO RELATED APPLICATION

This application is a continuation-in-part of application Ser. No. 09/267,190, filed Mar. 12, 1999 pending.

DESCRIPTION OF THE INVENTION

The present invention relates to stabilizing 1,2-dichloroethylene during storage. In particular, the present invention is directed to inhibiting the isomeric conversion of trans-1,2-dichloroethylene to cis-1,2-dichloroethylene during storage. More particularly, the present invention is directed to the use of stabilized 1,2-dichloroethylene as a solvent in cleaning operations which require a low residue producing solvent, for example, in the cleaning of mechanical components of high quality and precision.

1,2-Dichloroethylene (CAS No. 540-59-0) is a solvent used in industry for degreasing, in particular, vapor degreasing, and cleaning various surfaces, particularly for cleaning solid articles of complicated shape, e.g., printed circuit boards. It exists usually as a geometric isomer of trans-1,2-dichloroethylene (CAS No. 156-60-5) and cis-1,2-dichloroethylene (CAS No. 156-59-2). Upon storage, the trans-isomer spontaneously converts to the cis-isomer unless it is stabilized. At equilibrium. 1,2-dichloroethylene comprises the two geometric isomers in a 4:1 weight ratio of cis:trans.

The isomers of 1,2-dichloroethylene have distinct chemical and physical properties. In particular, the trans-isomer has a lower boiling point, density, viscosity and surface tension than the cis-isomer. Due to these attributes, trans-1,2-dichloroethylene is preferred over the cis-isomer for use in certain solvent cleaning applications. Such applications include azeotropic and azeotropic-like mixtures used for replacements of completely halogenated chlorofluoro hydrocarbons (C.F.C.'s). See U.S. Pat. No. 5,478,492 column 1, line 56. Therefore, it would be desirable to provide 1,2-dichloroethylene that is predominantly the trans-isomer, e.g., at least 90 weight percent.

The use of aliphatic aldehyde hydrazones for the stabilization of halogenated hydrocarbons has been disclosed. U.S. Pat. No. 3,043,888 describes their use for the stabilization of degreasing solvents, notably trichloroethylene, against decomposition during degreasing of metals. Also mentioned in the '888 patent, is that aldehyde hydrazones may be useful for stabilizing other liquid halogenated hydrocarbons of 1 to 3 carbons. U.S. Pat. No. 4,026,956 describes the use of aliphatic aldehyde hydrazones to minimize the formation of peroxides or acid in 1,3-dioxolane and/or 1,4-dioxolane stabilized methylchloroform formulations. U.S. Pat. No. 4,418,231 also describes their use as a stabilizer for 1,3-dioxolanes in halogenated solvents such as methylchloroform, trichloroethylene and mixtures thereof.

It has now been discovered that low concentrations of aliphatic aldehyde hydrazones, optionally in combination with an epoxide, effectively inhibit the isomeric transformation of trans-1,2-dichloroethylene to cis-1,2-dichloroethylene. It has also been discovered that the stabilized 1,2-dichloroethylene composition of the present invention produces minimal nonvolatile residue in cleaning operations when used alone or in combination with halocarbons in an azeotropic or azeotropic-like mixture.

DETAILED DESCRIPTION OF THE INVENTION

Other than in the operating examples, or where otherwise indicated, all values, such as those expressing quantities of ingredients, ranges or reaction conditions, used in this description and the accompanying claims are to be understood as modified in all instances by the term "about". In each instance where the term "weight percent" is used herein with respect to the composition of the present invention, it is to be understood that the described weight percent is based on the total weight of the composition.

In accordance with the present invention, a stabilizer has been found that is more efficient for stabilizing trans-1,2-dichloroethylene than the currently used stabilizer, i.e., hydroquinone monomethylether (HQMME). Due to this greater stabilization efficiency, less stabilizer is used. As a result, there is less non-volatile residue produced in critical cleaning operations.

In one embodiment, the present invention relates to a composition of 1,2-dichloroethylene comprising greater than 90 weight percent trans-1,2-dichloroethylene and a stabilizing amount of $C_1$–$C_7$ aliphatic aldehyde hydrazone, optionally in combination with a stabilizing amount of an epoxide. The aldehyde hydrazone used in the compositions of the present invention may be prepared by condensing an aliphatic aldehyde, notably aldehydes having from 1 to 3 carbon atoms such as formaldehyde, acetaldehyde, propionaldehyde, acrolein, chloral and dichloroacetaldehyde, with hydrazine or a substituted hydrazine. The hydrazine may be represented by graphic formula I:

I

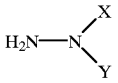

wherein X and Y are each hydrogen or alkyl groups having 1 to 4 carbons, e.g., dimethyl hydrazine, diethyl hydrazine, methyl hydrazine, ethyl hydrazine, methyl ethyl hydrazine and propyl methyl hydrazine. Preferably, the aliphatic aldehyde hydrazones used are those having a total of between 1 and 7 carbons, with no aliphatic group having more than 4 carbon atoms linked to the aldehyde hydrazone characterizing structure, which may be represented by graphic formula II:

II

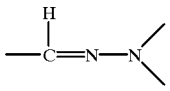

The aliphatic aldehyde hydrazones that may be used to stabilize trans-1,2-dichloroethylene in accordance with the present invention may be represented by graphic formula III:

III

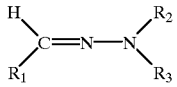

wherein each of $R_1$, $R_2$ and $R_3$ may be hydrogen or an aliphatic group (including saturated and unsaturated aliphatic groups) of from 1 to 4 carbons, with the proviso that the aliphatic aldehyde hydrazone has a total of from 1 to 7 carbon atoms in the aliphatic groups, $R_1$, $R_2$ and $R_3$. For most of the aliphatic aldehyde hydrazones, the sum of the carbon atoms in the groups represented by $R_1$, $R_2$ and $R_3$ is not more than 5. Often the aliphatic groups of the aliphatic aldehyde are alkyl groups. Aliphatic aldehyde hydrazones are described in U.S. Pat. Nos. 3,043,888, 4,026,956 and 4,418,231, the disclosures of which are incorporated herein by reference.

Examples of aliphatic aldehyde hydrazones include formaldehyde hydrazone, formaldehyde diethyl hydrazone, formaldehyde methyl ethyl hydrazone, acetaldehyde dimethyl hydrazone, acetaldehyde methyl ethyl hydrazone, formaldehyde isopropyl hydrazone, propionaldehyde hydrazone and mixtures thereof. Preferably, the aliphatic aldehyde hydrazone is selected from acetaldehyde dimethyl hydrazone, acetaldehyde methyl ethyl hydrazone or mixtures thereof, and more preferably, is acetaldehyde dimethyl hydrazone.

The amount of stabilizer which is present in the compositions of the present invention is a storage stabilizing amount, i.e., an amount sufficient to substantially inhibit the conversion of the trans-isomer to the cis-isomer during storage. The time for storage may be a short period of a few weeks or a longer period of up to several months. The amount of stabilizer may range from at least 1 part per million parts of the composition (ppm), preferably, at least 5 ppm, more preferably, at least 10 ppm, and most preferably, at least 15 ppm. The amount of stabilizer is usually less than 100 ppm, e.g., 95 ppm, preferably, not more than 75 ppm, more preferably, not more than 50 ppm, and most preferably, not more than 25 ppm. The amount of stabilizer used may range between any combination of these values, inclusive of the recited values.

The amount of trans-1,2-dichloroethylene present in the composition may also vary considerably. Other ethylenically unsaturated halogenated hydrocarbons may optionally be present when desired. Usually, trans-1,2-dichloroethylene constitutes at least 90 percent by weight of the composition. Frequently, trans-1,2-dichloroethylene constitutes at least 95 percent of the weight of the composition, preferably at least 99 percent by weight.

The storage stabilized 1,2-dichloroethylene compositions of the present invention may further comprise an epoxide as an acid acceptor. Typically the concentration of such epoxides may range from at least 0.001 weight percent, preferably, at least 0.01 weight percent, and more preferably, at least 0.02 weight percent, to not more than 1.0 weight percent, preferably, not more than 0.5 weight percent, and more preferably, not more than 0.2 weight percent of the total composition. The amount of epoxide may range between any combination of these values, inclusive of the recited values.

Examples of suitable epoxides include aliphatic and aromatic epoxides including those selected from epichlorohydrin; glycidol; propylene oxide; cis-2,3-pentene oxide; 2-methyl-2,3-epoxybutane; 1,2-epoxy-cyclopentene; 2,3-dimethyl-2,3-epoxybutane; 2-chloro-3,4-epoxybutane; 1-chloro-2,3-epoxybutane; styrene oxide; 1,2-epoxycyclohexane; butadiene diepoxide; butylene oxide, i.e., 1,2-butylene oxide and 2,3-butylene oxide. Preferably, the expoxide is a saturated mono-epoxide containing from 3 to 8 carbon atoms, ideally 4 to 6 carbon atoms, and saturated cycloaliphatic monoepoxides containing from 6 to 8 carbon atoms. Preferably, the epoxide is selected from 1,2-butylene oxide, 2,3-butylene oxide, 1,2-epoxycyclohexane or mixtures thereof, and most preferably, is 1,2-butylene oxide, 2,3-butylene oxide or mixtures thereof.

The present invention is more particularly described in the following examples which are intended as illustrative only, since numerous modifications and variations therein will be apparent to those skilled in the art.

EXAMPLE 1

A stabilized sample of trans-1,2-dichloroethylene was distilled for about 8 hours in a 20 plate Oldershaw distillation column to remove the stabilizers. Various levels of acetaldehyde dimethylhydrazone (ADH) were added to individual samples of the freshly distilled trans-1,2-dichloroethylene as indicated in Table 1.

TABLE 1

| Example # | ADH concentration ppm |
|---|---|
| 1A | 25 |
| 1B | 15 |
| 1C | 10 |
| 1D | 5 |
| Unstabilized | 0 |

COMPARATIVE EXAMPLE 1 (CE1)

The procedure of Example 1 was followed except that hydroquinone monomethyl ether (HQMME) was added to the unstabilized trans-1,2-dichloroethylene in an amount necessary to result in a concentration of 50 ppm.

COMPARATIVE EXAMPLE 2

According to the procedure of Example 1 of U.S. Pat. No. 3,043,888, the Federal Accelerated Oxidation (FAO) Procedure described in Miltary Specification MIL-T-7003, Sep. 5, 1950, was run on formulated samples of trichloroethylene, having the various levels of ADH listed in Table 2. The testing was done to demonstrate that the concentration of ADH used in the present invention to stabilize 1,2-dichloroethylene during storage would not be effective at stabilizing trichloroethylene when tested as described in U.S. Pat. No. 3,043,888.

The levels of hydrogen chloride measured in the test samples using ASTM D-2989-97 Standard Test Method for Acidity-Alkalinity of Halogenated Organic Solvents and their Admixtures are also listed in Table 2.

TABLE 2

| Examples | ADH (ppm) | HCL (ppm) |
|---|---|---|
| CE2A | 10 | >1636 |
| CE2B | 67 | 13 |
| CE2C | 100 | <1 |

The results of Table 2 show that concentrations of less than 100 ppm of ADH in trichloroethylene were unsuccessful in stabilizing trichloroethylene by allowing the formation of detectable levels of hydrogen chloride (HCL) when tested according to the FAO procedure.

EXAMPLE 2

Part A

Three reflux apparatuses were each charged with 800 milliliters (mL) of Example 1A, Comparative Example 1 (CE1) and unstabilized trans-1,2-dichloroethylene. Each reflux apparatus consisted of a 1000 mL round bottom flask equipped with a Friedrichs condenser having inserted therein a drying tube to remove water. The Friedrichs condenser was cooled by a mixture of ethylene glycol and water circulating through a refrigerated loop, i.e., a Forma Scientific circulating bath set to 1.0° C. Samples were collected before starting the refluxing, i.e., at time zero, and at selected intervals after starting the continuous refluxing for up to 50 days. Samples were analyzed for percent cis-1,2-dichloroethylene by gas chromatography. The results are reported in Table 3.

Part B

The procedure of Part A was followed except that Examples 1B, 1C and 1D were refluxed along with the unstabilized trans-1,2-dichloroethylene. The samples were refluxed for 6 days. The percent cis-1,2-dichloroethylene for samples taken at selected intervals is reported in Table 4.

Part C

A sample of Example 1A was stored for 26 days in an amber bottle padded with nitrogen at ambient temperature. It was analyzed before and after storage for percent cis-1,2-dichloroethylene by gas chromatography, pH by ASTM D-2989-97 and for non-volatile residue (NVR). The procedure for measuring the NVR consisted of the following steps: weigh and tare an aluminum weighing dish to 4 decimal places, i.e., 0.0000, on a suitable balance; add 100 mL of sample with a class A pipet; evaporate the sample with an infrared heat lamp; place the aluminum weighing dish in a forced draft oven at 105° C. for 30 minutes; remove the dish from the oven and cool in a desiccator; reweigh on the analytical balance; report the difference in weight, i.e., the increase over the tare weight, as NVR in ppm. Results are listed in Table 5.

Part D

Samples of Example 1A and Comparative Example 1 were analyzed for pH and nonvolatile residue within a few hours of their preparation. The results are listed in Table 6.

TABLE 3

| | Percent cis-1,2-dichloroethylene | | |
|---|---|---|---|
| Days | Unstabilized | Example 1A | CE 1 |
| 0 | 0.19 | 0.18 | 0.19 |
| 1 | 0.67 | 0.19 | 0.19 |
| 3 | 0.91 | 0.19 | 0.19 |
| 5 | 1.01 | 0.19 | 0.19 |
| 10 | 1.06 | 0.19 | 0.19 |
| 25 | 1.25 | 0.20 | 0.19 |
| 36 | 1.38 | 0.22 | 0.21 |
| 50 | 1.48 | 0.26 | 0.22 |

TABLE 4

| | Percent cis-1,2-dichloroethylene | | | |
|---|---|---|---|---|
| Days | Unstabilized | Example 1B | Example 1C | Example 1D |
| 0 | 0.14 | 0.14 | 0.16 | 0.16 |
| 1 | 0.41 | 0.17 | 0.17 | 0.16 |
| 4 | 0.51 | 0.17 | 0.17 | 0.16 |
| 5 | 0.57 | 0.17 | 0.17 | 0.17 |
| 6 | 0.61 | 0.17 | 0.18 | 0.17 |

TABLE 5

| | Results for Example 1A | | |
|---|---|---|---|
| Days | pH | NVR | Percent cis-1,2-dichloroethylene |
| 0 | 6.8 | <1 ppm | 0.15 |
| 26 | 6.7 | <1 ppm | 0.16 |

TABLE 6

| Sample | pH | NVR |
|---|---|---|
| Example 1A | 7.0 | 1.0 ppm |
| CE 1 | 6.7 | 8.0 ppm |

The results of Table 3 show that in the unstabilized sample, the conversion of the trans-isomer to the cis-isomer begins within one day and continues to increase over time. The results for Example 1A, stabilized with 25 ppm of ADH, showed comparable performance to CE 1, stabilized with 50 ppm of HQMME, over a period of 50 days under the conditions of continuous refluxing. The results of Table 4 for Examples 1B, 1C and 1D, stabilized with 15, 10 and 5 ppm of ADH, respectively, showed equivalent results over a 6 day interval of continuous refluxing. These results indicate that concentrations of ADH lower than 25 ppm are effective at stabilizing trans-1,2-dichloroethylene. The results of Table 5 show that the pH, NVR and percent cis-1,2-dichloroethylene of Example 1A did not substantially change over an interval of 26 days under the conditions of storage reported hereinbefore.

The results of Table 6 show that Example 1A, which was stabilized with 25 ppm ADH, had less non-volatile residue and a more neutral pH than Comparative Example 1, which was stabilized with 50 ppm of HQMME.

Although the present invention has been described with references to specific details of certain embodiments thereof, it is not intended that such details should be regarded as limitations upon the scope of the invention except in so far as they are included in the accompanying claims.

We claim:

1. A composition comprising at least 90 weight percent trans-1,2-dichloroethylene and a storage stabilizing amount of $C_1$–$C_7$ aliphatic aldehyde hydrazone represented by the following formula:

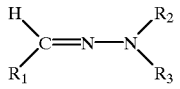

wherein $R_1$, $R_2$ and $R_3$ are each hydrogen or $C_1$–$C_4$ alkyl, provided that the total number of carbon atoms in the aliphatic group does not exceed 7.

2. The composition of claim 1 wherein the trans-1,2-dichloroethylene comprises at least 95 weight percent of the composition.

3. The composition of claim 1 wherein the aliphatic aldehyde hydrazone is formaldehyde hydrazone, formaldehyde diethylhydrazone, formaldehyde methylethylhydrazone, acetaldehyde dimethylhydrazone, acetaldehyde methylethylhydrazone, formaldehyde isopropylhydrazone, propionaldehyde hydrazone or mixtures thereof.

4. The composition of claim 3 wherein the aliphatic aldehyde hydrazone is acetaldehyde dimethylhydrazone, acetaldehyde methylethylhydrazone or mixtures thereof.

5. The composition of claim 4 wherein the aliphatic aldehyde hydrazone is acetaldehyde dimethylhydrazone.

6. The composition of claim 1 wherein the $C_1$–$C_7$ aliphthatic aldehyde hydrazone is present in an amount of from at least 1 ppm to less than 100 ppm.

7. The composition of claim 6 wherein the $C_1$–$C_7$ aliphthatic aldehyde hydrazone is present in an amount of from at least 5 ppm to not more than 75 ppm.

8. The composition of claim 7 wherein the $C_1$–$C_7$ aliphthatic aldehyde hydrazone is present in an amount of from at least 15 ppm to not more than 25 ppm.

9. The composition of claim 1 wherein the trans-1,2-dichloroethylene comprises at least 99 weight percent of the composition.

10. The composition of claim 1 further comprising from at least 0.001 to not more than 1.0 weight percent of an aliphatic or aromatic epoxide.

11. The composition of claim 10 wherein the epoxide is present in an amount of from at least 0.02 to not more than 0.2 weight percent.

12. The composition of claim 10 wherein the epoxide is selected from epichlorohydrin, glycidol, propylene oxide, cis-2,3-pentene oxide, 2-methyl-2,3-epoxy butane, 1,2-epoxycyclopentene, 2,3-dimethyl-2,3-epoxybutane, 2-chloro-3,4 -epoxybutane, 1-chloro-2,3-epoxybutane, styrene oxide, butadiene diepoxide, butylene oxide and mixtures thereof.

13. The composition of claim 12 wherein the epoxide is 1,2-butylene oxide, 2,3-butylene oxide, 1,2-epoxycyclohexane or mixtures thereof.

14. The composition of claim 13 wherein the epoxide is 1,2-butylene oxide, 2,3-butylene oxide, or mixtures thereof.

15. A composition comprising at least 99 weight percent trans-1,2-dichloroethylene and a storage stabilizing amount of acetaldehyde dimethylhydrazone.

16. The composition of claim 15 further comprising from at least 0.02 to not more than 0.2 weight percent of butylene oxide.

17. The composition of claim 15 wherein the acetaldehyde dimethylhydrazone is present in an amount of from at least 1 ppm to 95 ppm.

18. The composition of claim 16 wherein the acetaldehyde dimethylhydrazone is present in an amount of from at least 15 ppm to not more than 25 ppm.

* * * * *